US010793335B2

(12) United States Patent
Lin et al.

(10) Patent No.: US 10,793,335 B2
(45) Date of Patent: Oct. 6, 2020

(54) TAMPER EVIDENT BAG

(71) Applicant: Inteplast Group Corporation, Livingston, NJ (US)

(72) Inventors: Sumei Lin, Morristown, NJ (US); Li-yung Chang, Livingston, NJ (US); Ben Tseng, Somerset, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 15/884,664

(22) Filed: Jan. 31, 2018

(65) Prior Publication Data

US 2019/0233191 A1 Aug. 1, 2019

(51) Int. Cl.

| | |
|---|---|
| ***B65D 77/30*** | (2006.01) |
| ***B65D 33/08*** | (2006.01) |
| ***B65D 77/12*** | (2006.01) |
| ***B65D 33/01*** | (2006.01) |
| ***B65D 33/18*** | (2006.01) |

(52) U.S. Cl.

CPC ..... *B65D 77/30* (2013.01); *B65D 33/01* (2013.01); *B65D 33/08* (2013.01); *B65D 33/18* (2013.01); *B65D 77/12* (2013.01); *B65D 2401/10* (2020.05)

(58) Field of Classification Search

CPC ..... B65D 77/30; B65D 33/01; B65D 33/08; B65D 33/18; B65D 77/12

USPC ..... 383/5, 9, 10, 66, 84, 86, 87, 207–209

See application file for complete search history.

(56) References Cited

U.S. PATENT DOCUMENTS

| | | | | |
|---|---|---|---|---|
| 3,090,483 | A | 5/1963 | Altree et al. | |
| 3,124,298 | A * | 3/1964 | Repko | B65D 75/5844 383/207 |
| 3,896,966 | A | 7/1975 | Canno | |
| 4,483,018 | A | 11/1984 | Whelan | |
| 4,573,203 | A * | 2/1986 | Peppiatt | B65D 33/10 229/117.23 |
| 4,691,368 | A * | 9/1987 | Roessiger | B65D 31/04 206/526 |
| 4,834,552 | A | 5/1989 | Makowka | |

(Continued)

FOREIGN PATENT DOCUMENTS

| | | | |
|---|---|---|---|
| EP | 1845025 A1 * | 10/2007 | B65D 33/08 |
| GB | 2035258 | 6/1980 | |

(Continued)

OTHER PUBLICATIONS

Web-page for Seal2Go®—Pan Pacific, http://www.pppmi.com/seal-2-go/, 3 pages.

*Primary Examiner* — Jes F Pascua

(74) *Attorney, Agent, or Firm* — Stinson LLP

(57) ABSTRACT

A tamper evident bag has front and rear panels connected together along opposite first and second side edge margins and a bottom edge margins that define a bag interior and a first bag opening therebetween. The front and rear panels each have a tear line with a first end and a second end, the first and second ends being located at the first side edge margin. The first and second ends of each tear line being spaced part. The tear lines extend over the front and rear panels but remain spaced from the second side edge margin. Each tear line defines a respective tear out section on the front and rear panels. The tear out sections are joined along the first side edge margin and are configured to be removed to create a second bag opening.

15 Claims, 11 Drawing Sheets

(56) References Cited

U.S. PATENT DOCUMENTS

| | | | | | |
|---|---|---|---|---|---|
| 4,966,286 | A | | 10/1990 | Muckenfuhs | |
| 5,048,687 | A | | 9/1991 | Suzuki et al. | |
| 5,054,619 | A | | 10/1991 | Muckenfuhs | |
| D323,797 | S | | 2/1992 | Forman et al. | |
| 5,163,558 | A | * | 11/1992 | Palumbo | B65D 75/5833 206/494 |
| 5,361,905 | A | | 12/1994 | Bruno et al. | |
| 5,372,428 | A | | 12/1994 | Bruno et al. | |
| 5,482,376 | A | | 1/1996 | Moseley et al. | |
| 5,593,229 | A | | 7/1997 | Warr | |
| 5,655,843 | A | * | 8/1997 | Conrad | B65D 33/10 383/204 |
| 5,666,445 | A | * | 9/1997 | Conrad | B65D 33/10 383/207 |
| 5,676,467 | A | | 10/1997 | Gebhardt | |
| 5,741,077 | A | | 4/1998 | Sasaki et al. | |
| 5,951,166 | A | | 9/1999 | Matsumoto | |
| 6,033,392 | A | * | 3/2000 | Frey | A61J 1/16 206/365 |
| D557,148 | S | | 12/2007 | Kapinos, Sr. | |
| 7,530,740 | B2 | * | 5/2009 | Geyer | B65D 33/004 383/10 |
| D777,569 | S | | 1/2017 | Boekeloo et al. | |
| D799,337 | S | | 10/2017 | Bhati | |
| 2006/0124494 | A1 | * | 6/2006 | Clark, Jr. | B65D 75/5833 206/440 |
| 2011/0045220 | A1 | * | 2/2011 | Rush | B32B 27/32 428/35.5 |
| 2017/0050768 | A1 | | 2/2017 | Tseng et al. | |
| 2017/0253385 | A1 | * | 9/2017 | Sargin | B65B 51/02 |
| 2018/0162603 | A1 | | 6/2018 | Tan | |

FOREIGN PATENT DOCUMENTS

| | | | | | |
|---|---|---|---|---|---|
| GB | 2339187 | A | * | 1/2000 | B65D 31/08 |
| JP | 03029754 | A | * | 2/1991 | |
| JP | 08182524 | A | * | 7/1996 | |
| JP | 2009269622 | A | | 11/2009 | |
| WO | WO-9818678 | A1 | * | 5/1998 | B65B 61/18 |

* cited by examiner

TAMPER EVIDENT BAG

FIELD OF THE INVENTION

The present invention generally relates to a bag, and more specifically, to a tamper evident bag used to carry food.

BACKGROUND

Bags are commonly used to hold and enclose food and other products. In one application, bags are used in food delivery applications—to transport prepared meals from a restaurant to a place of delivery, such as a home. When prepared meals are transported in this manner, it is beneficial to provide customers with the confidence that the ordered meals have not been touched or tampered with during delivery, for example, by a delivery driver. To provide such confidence to customers, the customers need to know if the bag is subsequently opened after the food is placed in the bag at the restaurant.

SUMMARY

In one aspect, A tamper evident bag comprises front and rear panels. The front and rear panels have front and rear surfaces and top, bottom, and opposite first and second side edge margins. The front and rear panels are connected together along the first and second side edge margins and the bottom edge margin to define a bag interior between the front surface of the rear panel and the back surface of the front panel. The front surface of the rear panel and the top edge margin of the front panel define a first bag opening therebetween sized and shaped for inserting one or more items into the bag interior. The bag includes a handle. The front and rear panels each have a tear line with a first end and a second end, the first and second ends located at the first side edge margin. The first and second ends are spaced from the top and bottom edge margins and from each other. Each tear line extends over the front and rear panels to define a respective tear out section therein. The tear lines are everywhere spaced from the second side edge margin. The tear out sections are joined along the first side edge margin and configured to be removed to create a second bag opening in the front and rear panels.

In another aspect, a tamper evident bag comprises front and rear panels. The front and rear panels have front and rear surfaces and top, bottom, and opposite first and second side edge margins. The front and rear panels are connected together along the first and second side edge margins and the bottom margins to define a bag interior between the front surface of the rear panel and the back surface of the front panel. The top edge margin of the front panel extends across the front surface of the rear panel at a location spaced from the top edge margin of the rear panel toward the bottom edge margin of the rear panel. The front surface of the rear panel and the top edge margin of the front panel define a first bag opening therebetween. A closure panel has top and bottom edge margins. The closure panel is secured to the rear panel and configured to close the first bag opening. The closure and rear panels include handles at the top edge margins.

DETAILED DESCRIPTION

Figure 1:
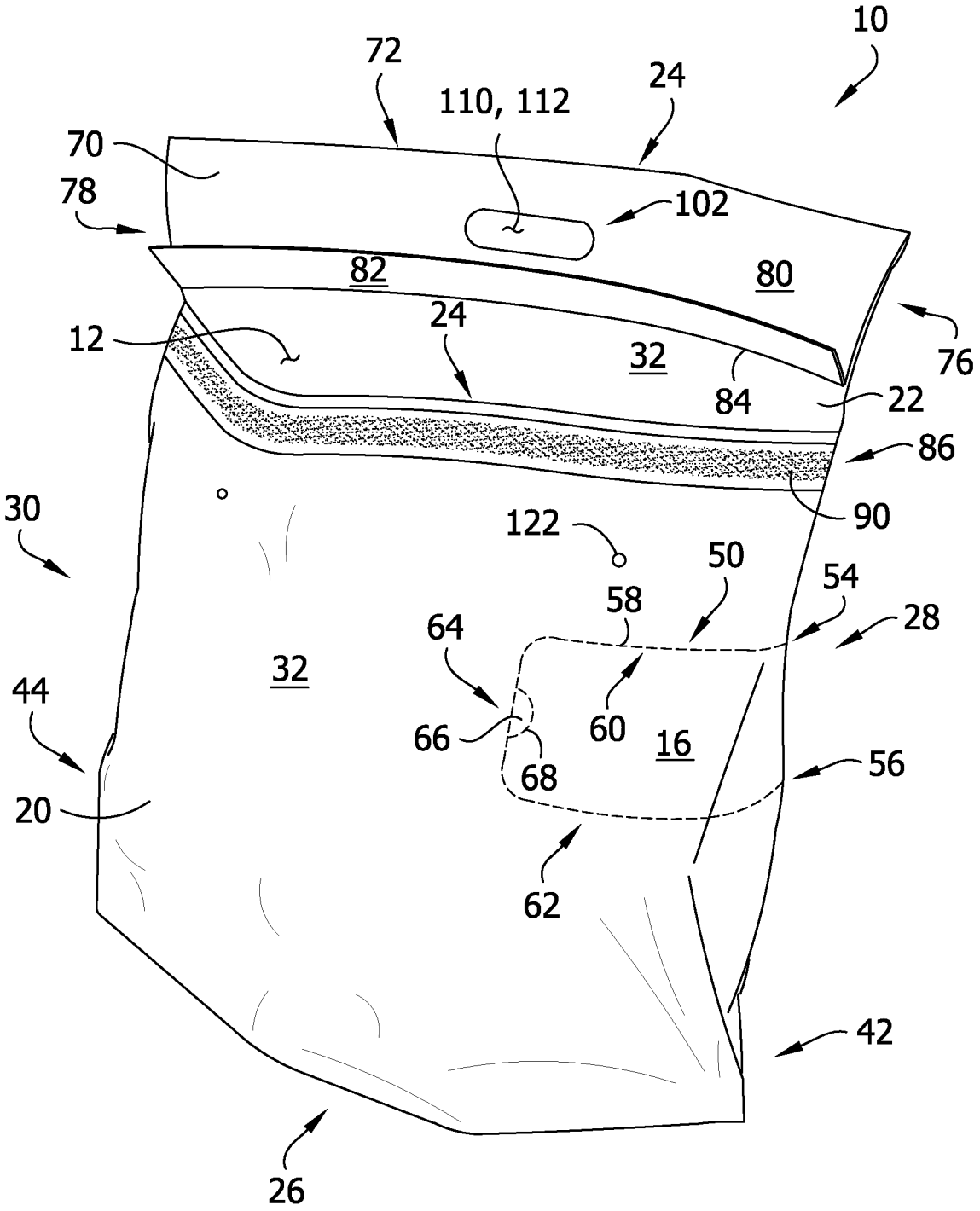
FIG. 1 is a perspective of a tamper evident bag according to one embodiment of the present disclosure with an open first opening.
Figure 2:
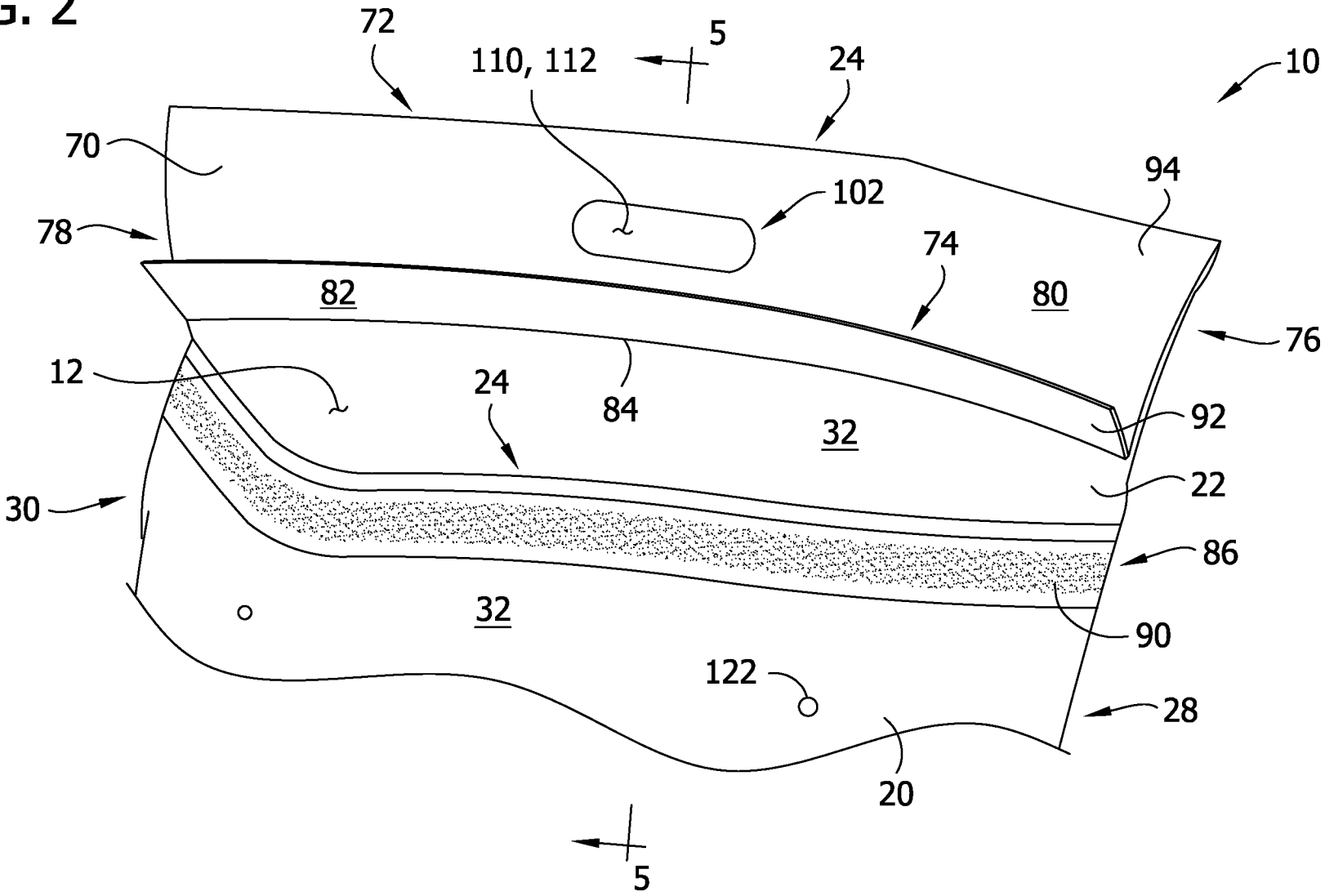
FIG. 2 is an enlarged, fragmentary perspective of a top of the tamper evident bag of FIG. 1.
Figure 7:
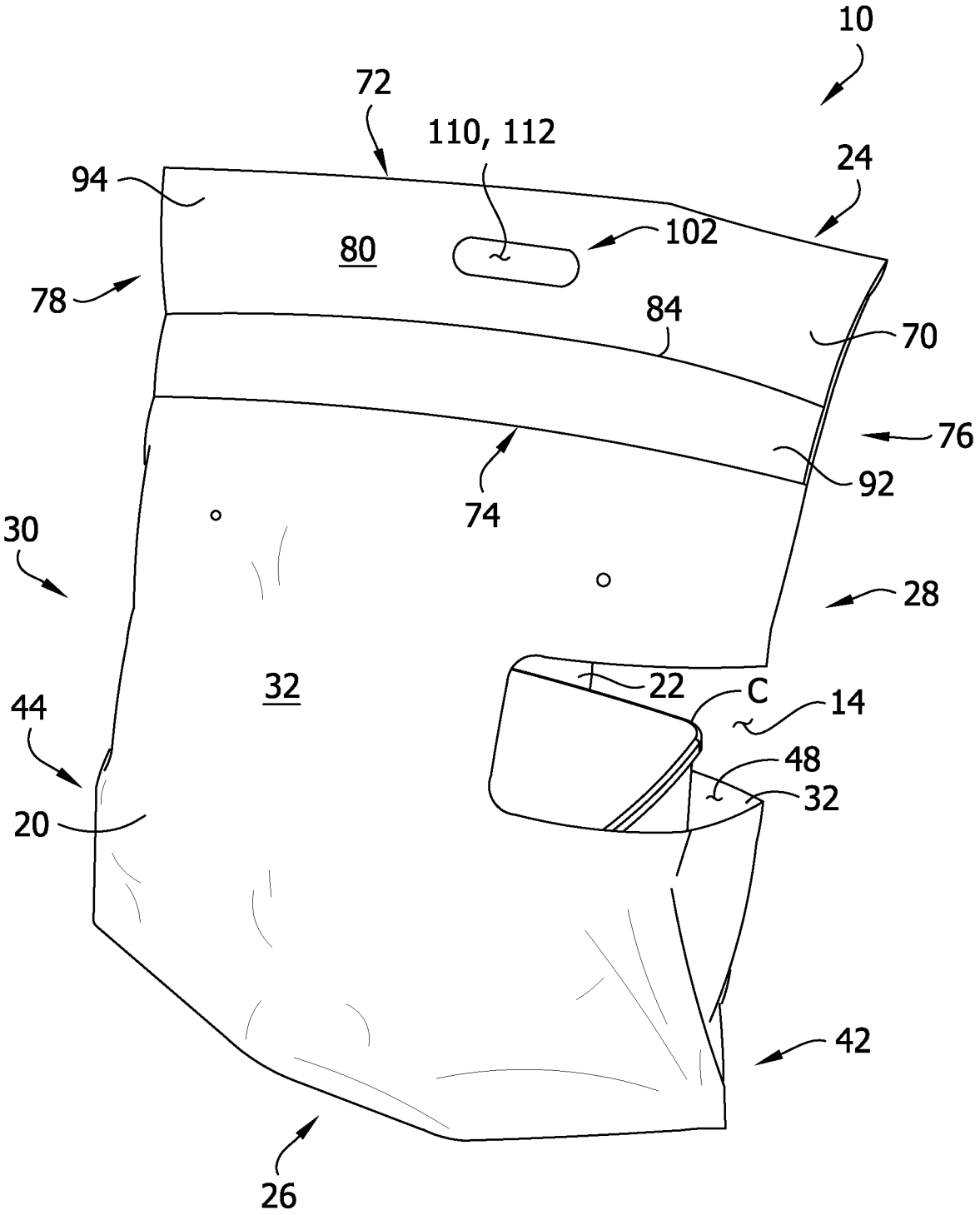
FIG. 7 is a perspective of the tamper evident bag of FIG. 1 with a closed first opening and tear out sections removed.

Referring to FIGS. 1 and 7, a tamper evident bag of the first embodiment of the present disclosure is generally indicated at 10. In this embodiment, the bag 10 includes a first opening 12 and a second opening 14. As will be discussed in more detail below, the first opening 12 is configured to be permanently closed and the second opening 14 is formed only when tear out sections 16 are removed from the bag by a user. Once the first opening 12 of the bag 10 is closed, the only way to access the contents contained within the bag is to remove the tear out sections 16 to create the second opening 12 (or otherwise tear open the bag). In this manner, by visually inspecting the bag 10 to make sure the first opening 12 is sealed, the tear out sections 16 are in place and the bag is not otherwise damaged, the user will know the contents of the bag were not tampered with once the contents were placed in the bag.

Figure 8:
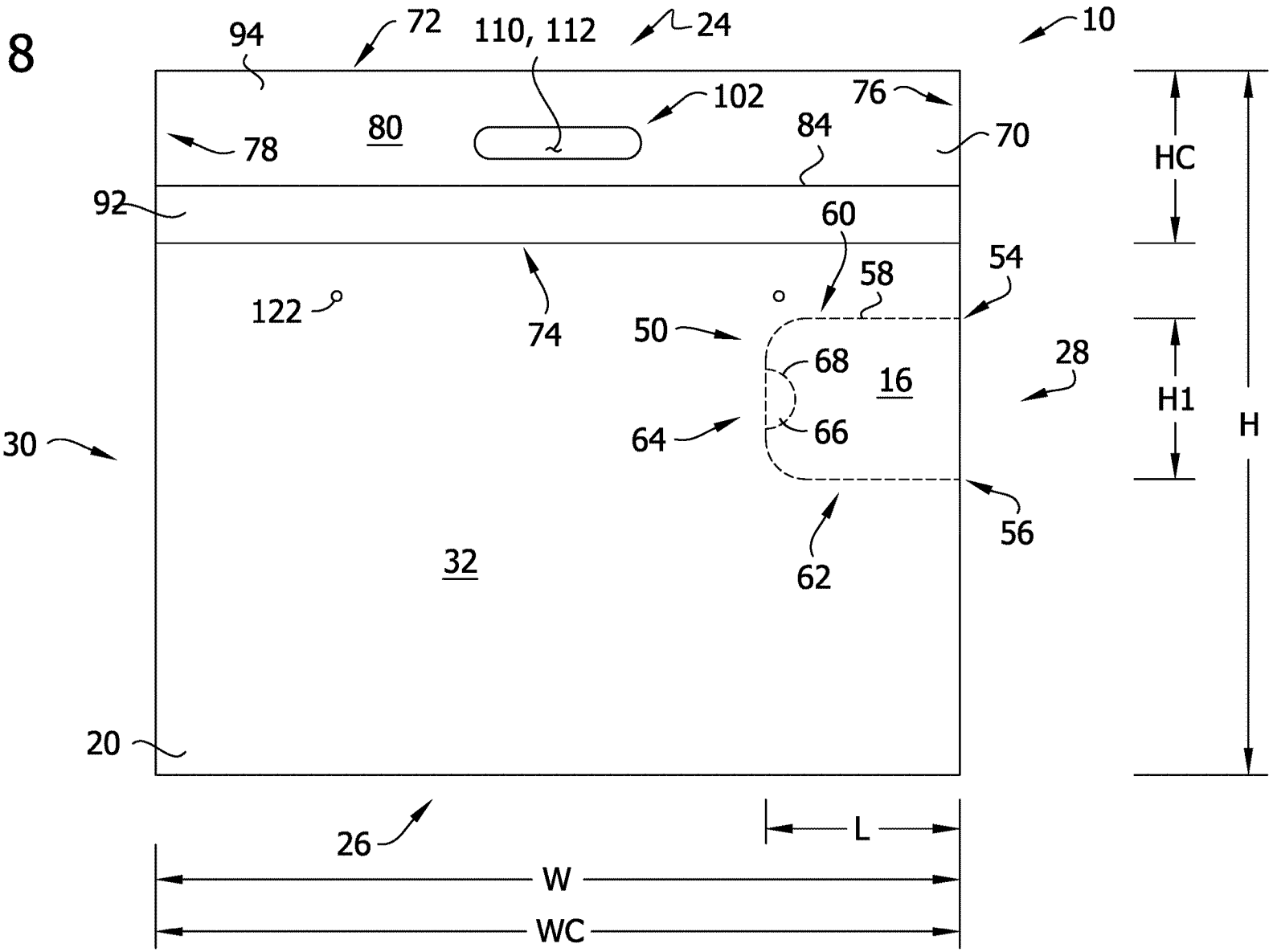
FIG. 8 is a front view of the tamper evident bag of FIG. 1.

Referring to FIGS. 1-8, the first embodiment of a bag 10 of the present disclosure is shown. The bag 10 includes front and rear panels 20 and 22, respectively. The front and rear panels 20, 22 are each four-sided with a top margin 24, a bottom margin 26, and opposite first and second side margins 28 and 30, respectively. The front and rear panels 20, 22 each have front and rear surfaces 32 and 34, respectively. The distance between the free edges of top and bottom edge margins 24, 26 of the rear panel 22 defines a height H of the bag 10 (FIG. 8). The first and second side edge margins 28, 30 define a width W of the bag 10. In the preferred embodiment the bag 10 has a height H of 17.5 inches (44.5 cm) and a width W of 20 inches (51 cm). However, it is understood that other dimensions are within the scope of the present invention. As used throughout the present disclosure with respect to the bag, the terms defining relative locations and positions of structures and components of the bag, including but not limited to the terms "top," "bottom," "side," "front," and "rear," are meant to provide a point of reference for such components and structures as shown in the drawings, with the understanding that the respective relative locations of such components and structures will depend on the orientation of the bag in use.

Figure 4:
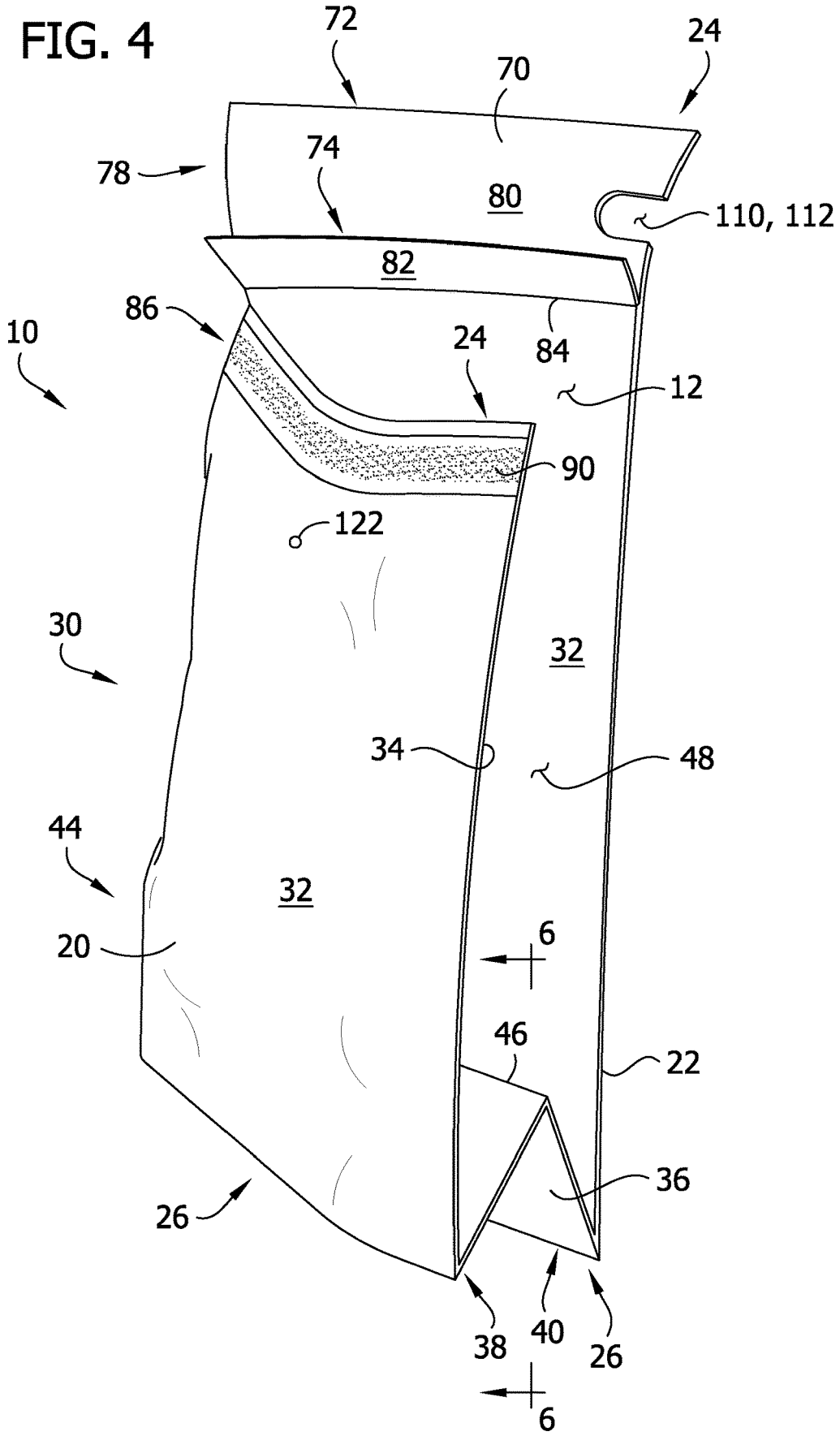
FIG. 4 is a vertical cut away view of the tamper evident bag of FIG. 1.

The front and rear panels 20, 22 are joined at the first and second side edge margins 28, 30. The top edge margins 24 of the front and rear panels 20, 22 are not joined and are not aligned. The top edge margin 24 of the front panel 20 is positioned between the top and bottom edge margins 24, 26 of the rear panel 22. In the illustrated embodiment, the top edge margin 24 of the front panel 20 is positioned proximate to but below the top edge margin 24 of the rear panel 22. The rear surface 34 of the front panel 20 and the front surface 32 of the rear panel 22 define a bag interior 48 therebetween (FIG. 4). The top edge margin 24 of the front panel 20 and the front surface 32 of the rear panel 22 define the first opening 12 to the bag interior 48 (the first opening is, broadly, in communication with the bag interior). In the preferred embodiment, the bottom edge margins 26 are not joined directly to each other but are instead connected together with a gusset or bottom panel 36. The gusset 36 spans between and interconnects the bottom edge margins 26 of the front and rear panels 20, 22. The gusset 36 has opposite front and rear edge margins 38 and 40, respectively, and opposite first and second side edge margins 42 and 44, respectively. The front edge margin 38 is connected to the bottom edge margin 24 of the front panel 20 and the rear edge margin 40 is connected to the bottom edge margin 24 of the rear panel 22. The gusset 36 is folded back on itself along a fold line 46. When the bag 10 is in the flat orientation shown in FIG. 6, the fold line 46 is positioned in the bag interior 48 between the top and bottom edge margins 24, 26. A segment of the first side edge margin 42 of the gusset 36 is joined to another segment of the first side edge margin with both segments being joined to the first side edge margins 28 of the front and rear panels 20, 22. Likewise, a segment of the second side edge margin 44 is joined to another segment of the second side edge margin with both segments being joined to the second side edge margin 30 of the front and rear panels 20, 22. The bag interior 48 is sized and shaped to receive one or more items inserted therein. The gusset 36 can flatten along fold line 46 to provide the bag 10 with a flat bottom surface on which an item in the bag may rest when the bag is being carried, allowing the bag to better receive and transport bulky items or containers. Alternatively, the bag 10 may not include the gusset. In this case, the front and rear panels (not shown) would be joined along the bottom edge margins.

Figure 6:
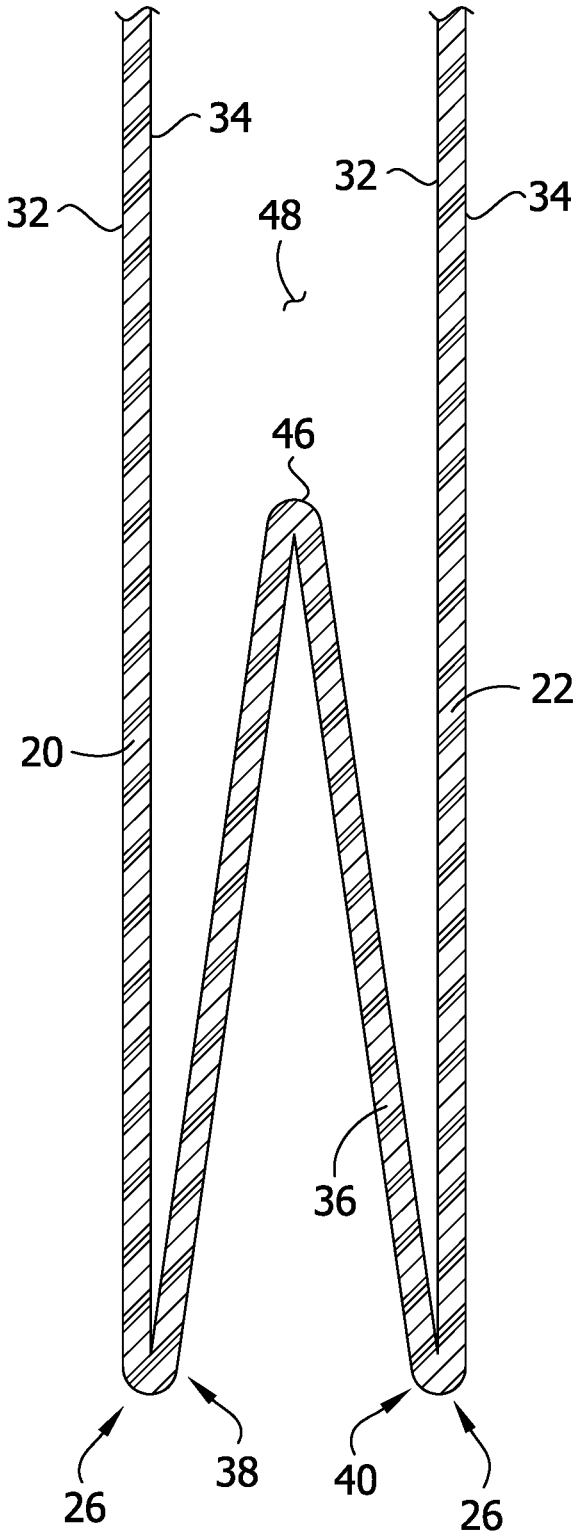
FIG. 6 is an enlarged, fragmentary section of a bottom of the tamper evident bag taken through line 6-6 of FIG. 4.

In the preferred embodiment, the gusset 36 and front and rear panels 20, 22 are formed from a single sheet of material that is folded at the bottom of the bag 10 along the bottom edge margins 26 and the fold line 46. In this case, the gusset 36 is continuous with the front and rear panels 20, 22 (FIG. 6). Heat formed fusion lines join the side margins 28, 30, 42, 44. The gusset 36 and front and rear panels 20, 22 can be joined in other manners within the scope of this invention. For example, in some embodiments (not shown), fusion lines join separate panel and gusset sheets along the bottom edge margins and first and second side edge margins. In some embodiments, the margins 26, 28, 30 are joined to form a fluid tight, liquid tight, and/or gas tight seal. In other embodiments, the margins can be joined without forming a seal. It will be understood, that other constructions may be used within the scope of the present invention.

Furthermore, in another embodiment, a bag 10' can include corner seals 200. An example of such a bag is generally indicated at 10' in FIG. 9. In this embodiment, the front and rear panels (only the front panel 20' is shown) are similar to the front and rear panels 20, 22 of bag 10 except the front and rear panels include angled first and second corner edge margins 202 and 204, respectively. The first corner edge margin 202 extends from the first side edge margin 28' to the bottom edge margin 26'. Likewise, the second corner edge margin 204 extends from the second side edge margin 30' to the bottom edge margin 26'. In the illustrated embodiment the first and second corner edge margins 202, 204 are at a 40 degree angle with respect to the bottom edge margin 26', however other angle orientations are within the scope of the present invention. The gusset 36' is similar to the gusset 36 of bag 10 except the opposite first and second side edge margins of the gusset 36' include segments that are angled to match the respective first and second corner edge margins 202, 204 when the gusset 36' is folded along a central fold line. The segments of the first side edge margin of the gusset 36' are joined to each other and the first corner edge margin 202 of the front panel 20' and rear panel and the segments of the second side edge margin are joined to each other and the second corner edge margin 204 of the front and rear panels. It is understood that the corner seals 200 can be implemented in any of the bags described herein. Bag 10' can be formed from a single sheet of material like bag 10, except, once the material is folded, as described above, the material is cut to form the corner edge margins 202, 204 and angled segments of the gusset 36'. All of the components at the corner margins 200, 204 are joined together in a suitable manner, such as by heat sealing.

Referring again to FIGS. 1-8, the front panel 20 of the bag 10 includes an adhesive member 86 fixed to the front panel. The adhesive member 86 is located proximate the top edge margin 24 of the front panel 20 and extends between the first and second side edge margins 28, 30 on the front surface 32 of the front panel. As described in more detail below, the adhesive member 86 is used to permanently close the first opening 12. The adhesive member 86 includes a protective release strip (not shown), such as a length of plastic film. The release strip protects the adhesive member 86 from bonding to another surface prematurely and is configured to be peeled away to expose an adhesive 90 of the when the first opening 12 is ready to be closed, such as after a container C of food has been placed in the bag 10 through the first opening 12. Preferably, the release strip does not permanently bond with the adhesive 90 and adhesive is of a type that adheres strongly on contact with the material of the rear panel 22. The adhesive member 86 can be fixed to the front panel 20 using adhesive, which can be the same as adhesive 90, or any other suitable means for attachment. In the preferred embodiment, the top of the adhesive member 86 is located 0.2 inches (5 mm) from the top edge margin 24 of the front panel 20.

Referring to FIGS. 1 and 8, a tear line 50 is included on each of the front and rear panels 20, 22 of bag 10. Each tear line 50 defines the tear out section 16 on the front and rear panels 20, 22. As will be described in more detail below, the tear out sections 16 are configured to be removed from the front and rear panels 20, 22 to provide a second opening 14 to the bag interior 48 (the second opening is, broadly, in communication with the bag interior) (FIG. 7). Each tear line 50 has a first end 54 and a second end 56 (FIG. 1). The first and second ends 54, 56 are located at the first side edge margin 28. The first and second ends 54, 56 of each tear line 50 are spaced apart from each other and the top and bottom edge margins 24, 26. The distance between the first and second ends 54, 56 defining a height H1 of the tear out sections 16 (FIG. 8). The tear lines 50 extend over the front and rear panels 20, 22. However, the tear lines 50 to not extend to or contact the second side edge margin 30. Thus, every point along the tear lines 50 is spaced apart from the second side edge margin 30. Because the end points 54, 56 of the tear lines 50 are located at the joined first edge margin 28, the tear out sections 16 are joined together at the first edge margin.

The tear lines 50 are formed by perforations 58 (i.e., each tear line 50 is made up of perforations). The perforations 58 extend between the first and second ends 54, 56 of each tear line 50. The perforations 58 are sized to allow the user to tear or rip the tear out sections 16 from the bag 10 along the tear lines 50 to create the second opening 14. At the same time, the perforations 58 are sized and arranged to prevent the perforations from ripping under the weight of the items received in the bag interior 48 while the bag 10 is used to transport the items. The perforations 58 defining the tear lines 50 on the front and rear panels 20, 22 can be formed from a single punching operation. In this way, as shown in the illustrated embodiment, the tear lines 50 on the front and rear panels 20, 22 are aligned with each other. Accordingly, the tear out sections 16 are aligned in with each other. However, in other embodiments (not shown), the tear out sections 16 may not be aligned.

Figure 5:
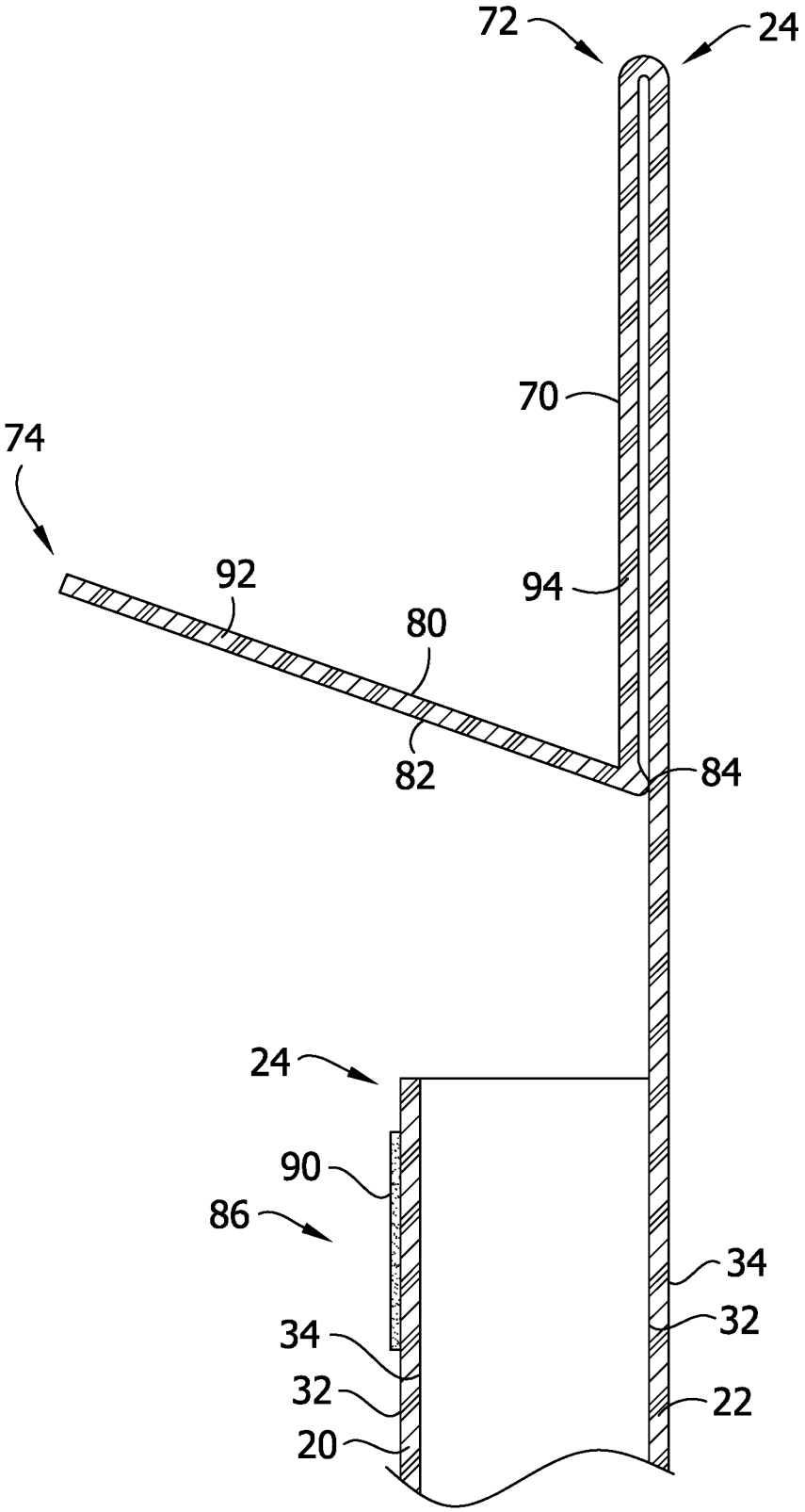
FIG. 5 is an enlarged fragmentary section of the top of the tamper evident bag taken through line 5-5 of FIG. 2.

In the illustrated embodiment, the tear lines 50 define tear out sections 16 that are generally rectangular in shape. The tear lines 50 have a first segment 60, a second segment 62 and a third segment 64. The first segment extends from the first side edge margin 28 toward the second side edge margin 30. The second segment 62 is positioned between the first segment 60 and the bottom edge margin 26 and extends from the first side edge margin 28 toward the second side edge margin 30. The third segment 64 interconnects the first and second segments. As seen in FIG. 5, the third segment 64 is generally linear with rounded ends (corners) at the first and second segments 60, 62. These rounded corners help better transfer the ripping or tearing forces from the third segment 64 to the first and second segments 60, 62. It is understood that the tear out sections 16 can have other shapes as well without departing from the scope of the present invention. For example, in another embodiment shown in FIG. 9, the tear line 50' defines a partial oval shaped tear out section 16'. In another example, the third segment 64 can be semi-circular in shape (FIG. 10).

Referring back to FIGS. 1 and 8, the tear out sections 16 are generally located near the middle of the height H of the bag 10. In other words, a midpoint of the height H of the bag 10 generally along the first side edge margin 28 is located on the tear out sections 16. The tear out sections 16 extend generally horizontally from the first side edge margin 28 toward the second side edge margin 30. In the preferred embodiment, the tear out sections 16 extend approximately a quarter of the way to the second side edge margin 30. Accordingly, the length L of the tear out sections 16 is approximately a quarter of the width W of the bag 10. It is understood that the tear out sections 16 may extend across the front and rear panel 20, 22 at other lengths L that are within the scope of the present invention. For example, in another embodiment shown in FIG. 10, the tear out sections 16" extend across the front and rear panels 20", 22" at a length L that is approximately half of the width W of the bag 10". Tear out sections 16 with a length L that is less than a quarter of the width W of the bag 10 are also within the scope of the present invention. Moreover, the tear out sections 16 may not extend horizontally across the front and rear panels 20, 22, as shown, but at an angle thereto. However, the tear out sections 16 and, therefore, the tear lines 50 most preferably do not extend all the way across the bag 10. The perforations 58 that form the tear lines 50 reduce the strength of the front and rear panels 20, 22, i.e. reduces the amount of weight that can be carried by the bag 10. The longer the length L of the tear out sections, the greater the reduction in the strength of the bag 10. By not extending the tear out sections 16 and, therefore, the tear lines 50 across the entire width W of the bag 10, the strength of the bag is maintained. Accordingly, the bag 10 can carry heavier loads than, for example, a bag with perforations extending across the entire bag. Alternatively, the bag 10 may be made of a less expensive, lower strength material. Still further, by maintaining the integrity of a portion of the front and rear panels 20, 22 (i.e. the perforations 58 do not extend across the entire bag 10), the strength of the perforations 58 can be adjusted to make it easier (require less force) to remove the tear out sections 16. In contrast, for bags with perforations extending across the entire bag, the amount of weight the bag can carry is limited to the strength of the perforations. This results in perforations that are more difficult (require more force) to break in order for the bag to hold an acceptable amount of weight. Accordingly, the bags of the present disclosure can carry the same or greater amount of weight while having perforations that are easier to tear than other bags. In the illustrated embodiment, the perforations 58 have a cut length of 1 to 2 mm (0.04 to 0.08 inches) with an interval between cuts of 2 to 4 mm (0.08 to 0.16 inches), however, other perforation configurations are within the scope of the present invention.

The exact height H1 and length L of the tear out sections 16 can vary depending upon the needs of the user and the size of the items the bag 10 is designed to carry. As described in more detail below, removing the tear out sections 16 creates the second opening 14 (FIG. 7). Thus, the size of the tear out sections 16 corresponds to the size of the second opening 14. In the preferred embodiment, the tear out sections have a height H1 of approximately 4.5 inches (11.5 cm) and a length L of 5 inches (12.7 cm), with the top of the tear out sections (the first segment of tear line 50) located approximately 2.4 inches from the top edge margin 24 of the front panel 20. These dimensions correspond to a bag 10 with a height H of 17.5 inches (44.5 cm) and a width W of 20 inches (51 cm). However, it is understood that bag, or parts thereof, may have other dimensions than described herein that are within the scope of the present invention.

Adjacent to each tear line 50 is a finger slot 66. In the illustrated embodiment the finger slot 66 is positioned next to the third segment 64, however, the finger slot 66 can be positioned anywhere along the tear line. The finger slot 66 is defined by the tear out line 50 and a finger slot line 68. The finger slot line 68 is also formed by perforations 58. The perforations 58 of the finger slot line 68 may the same or different than the perforations 58 of the tear out lines 50. Each finger slot line 68 extends over one of the tear out sections 16. As described in more detail below, each finger slot 66 is configured to receive a finger of the user to allow the user to better grip one or both of the tear out sections 16.

The bag 10 can include vent holes 122 located on the front and/or rear panels 20, 22. The vent holes 122 are positioned proximate the top edge margin 24 of the front panel 20. In the illustrated embodiment, two vent holes 122 are positioned one each side of the front and rear panels 20, 22. The vent holes 122 are located approximately 2.9 inches (7.3 cm) from the top edge margin 24 of the front panel. The vent holes 122 on the front and rear panels 20, 22 can be aligned or unaligned.

Referring to FIGS. 1-8, a closure panel 70 is located at the top of the bag 10. The closure panel 70 is configured to close the first opening 12 to block access to the bag interior 48 through the first opening. The closure panel 70 has a top edge margin 72, a bottom edge margin 74 and first and second side edge margins 76 and 78, respectively. The closure panel 70 has opposite front and rear surfaces 80 and 82, respectively. The closure panel 70 has a width WC between the first and second side edge margins 76, 78 and a height HC between the top and bottom edge margins 72, 74. In the illustrated embodiment, the width WC of the closure panel 70 is coextensive with the width W of the bag 10 such that the first and second side edge margins 76, 78 of the closure panel are aligned with the first and second edge margins 28, 30 of the front and rear panels 20, 22. In the illustrated embodiment, the closure panel 70 has a height HC of 4.1 inches (10.5 cm). As described in more detail below, the bag 10 is configured such that the closure panel 70 is sealable to the front panel 20 to permanently close the first opening 12.

The closure panel 70 is joined to the rear panel 22 at the top of the bag 10. As shown, the closure panel 70 is part of the single sheet of material with the rear panel 22 and the front panel 20. The top edge margin 72 of the closure panel 70 is aligned with the top edge margin 24 of the rear panel 22. In the preferred embodiment, the rear surface 82 of the closure panel 70 is joined to the front surface 32 of the rear panel 22 along a connection line 84. The connection line 84 can be a fusion line that connects the closure and rear panels 70, 22 or any other suitable means for attachment. On the rear panel 22, the connection line 84 extends between the first and second side edge margins 28, 30, and is positioned between the top edge margin 24 of the rear panel 22 and the top edge margin 24 of the front panel 20. On the closure panel 70, the connection line 84 extends between the first and second side edge margins 76, 78, and is positioned between the top and bottom edge margins 72, 74 of the closure panel 70. The connection line 84 is located proximate to the top edge margin 24 of the front panel 20. In the preferred embodiment, the connection line 84 is located 0.2 inches (5 mm) from the top edge margin 24 of the front panel 20 and 1.4 inches (3.5 cm) from the bottom edge margin 74 of the closure panel 70. The connection line 84 divides the closure panel 70 into a flap portion 92 extending between the bottom edge margin 78 and the connection line 84 and a handle portion 94 extending between the connection line 84 and the top edge margin 76.

The closure panel 70 is arranged to overlap the top edge margin 24 of the front panel 20 and a portion of the front surface 32 of the front panel. More specifically, the closure panel 70 is arranged such that the flap portion 92 overlaps and completely covers the adhesive member 86 on the front panel 20. The height HC of the closure panel 70 is greater than the distance between the first edge margins 24 of the front and rear panels 20, 22. More precisely, the distance between the connection line 84 and the bottom edge margin 74 of the closure panel 70 (the height of the flap portion 92) is greater than the distance between the connection line 84 and the lower longitudinal edge of the adhesive member 86 on the front panel 20. In this manner, the bottom portion 92 extends over the front panel 20 such that the bottom edge margin 74 of the closure panel 70 is positioned along the front surface 32 of the front panel between the top and bottom edge margins 24, 26 of the front panel but below the adhesive member 86. This arrangement allows the flap portion 92 of the closure panel 70 to engage the adhesive member 86 to permanently close the first opening 12.

Figure 10:
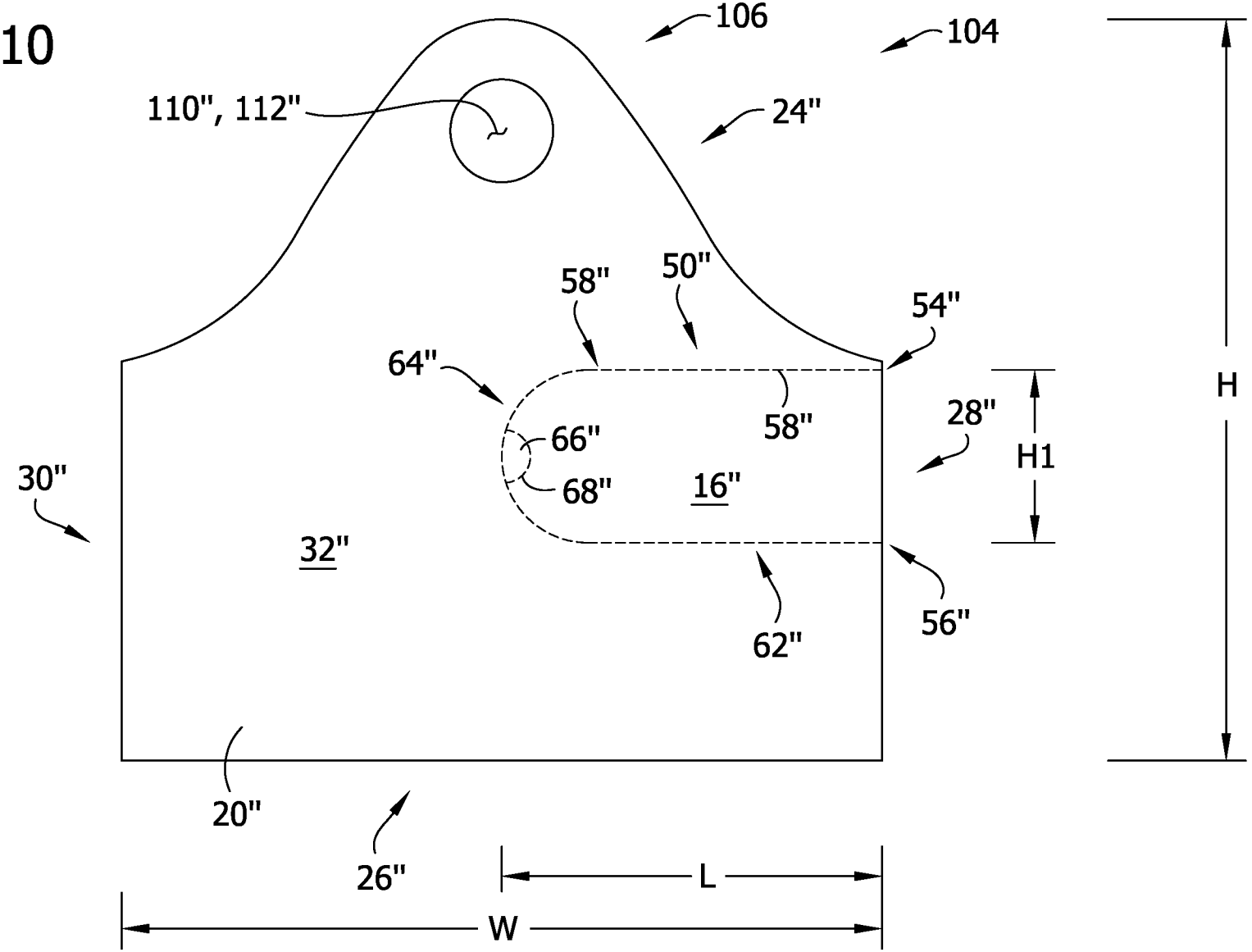
FIG. 10 is a front view of another embodiment of a tamper evident bag.
Figure 11:
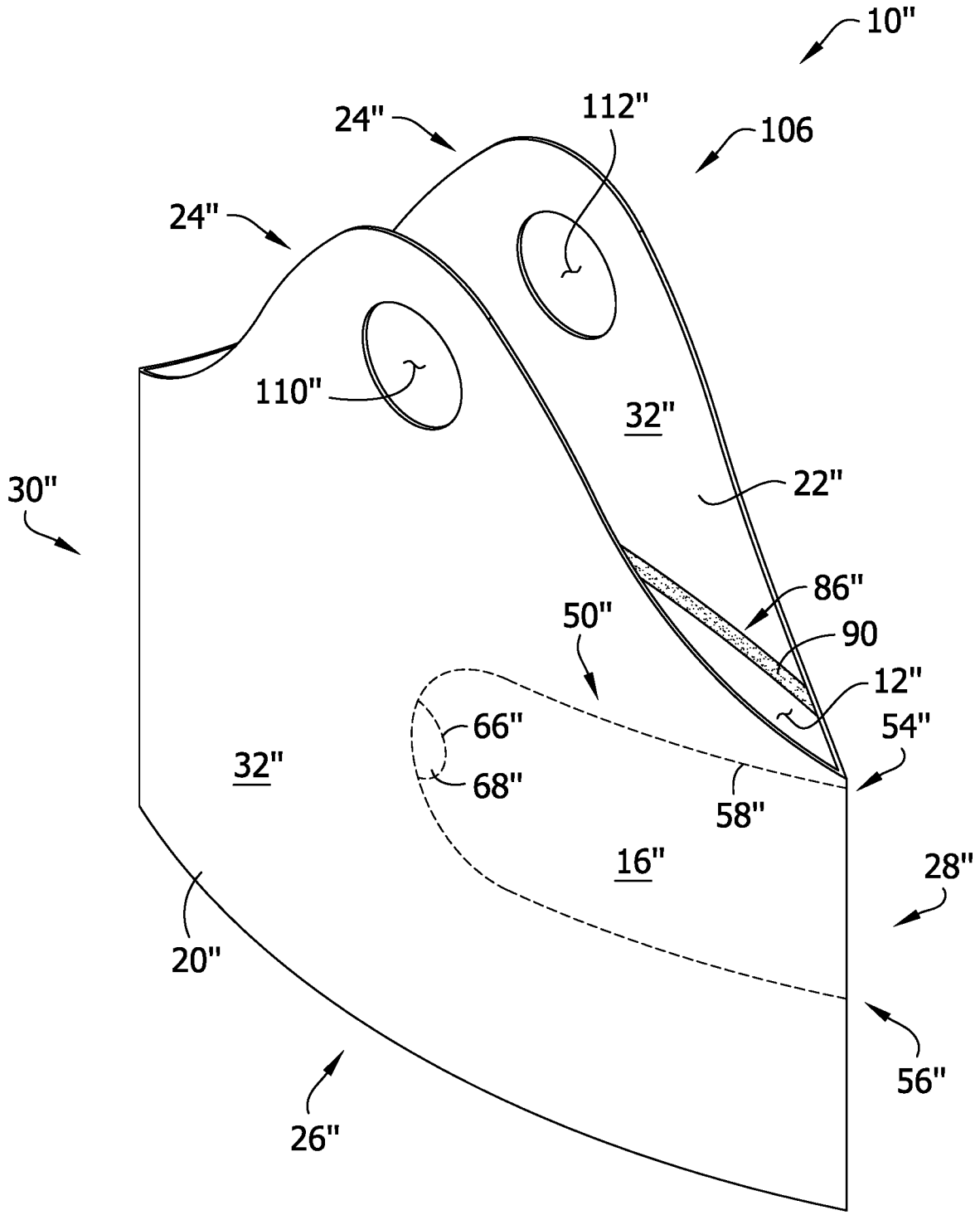
FIG. 11 is a perspective of the tamper evident bag of FIG. 10 with an open first opening; and Corresponding reference characters indicate corresponding parts throughout the drawings.

The bag 10 can include any one of a number of different handle configurations. For example, the bag 10 can have a die cut handle 102 (FIGS. 1-8), a soft-loop handle 104 (FIG. 9), or a wave-top handle 106 (FIGS. 10 and 11). The bag 10 can have other handle configurations than describe herein that are within the scope of the present invention.

In the embodiment shown in FIGS. 1-8, the bag 10 includes the die cut handle 102. The die cut handle 102 is centrally located at the top of the bag 10. The die cut handle 102 includes a first handle opening 110 on the handle portion 94 of the closure panel 70 and a second handle opening 112 on the rear panel 22. The first and second handle openings 110, 112 are aligned and located proximate the top edge margins 72, 24 of the closure and rear panels 70, 22. The first and second handle openings 110, 112 are configured to allow a user's hand to be inserted therethrough, permitting the user to grasp the bag 10. The doubling of material provided by the handle portions 94 and top edge margin 24 of the rear panel 22 strengthens the bag 10 at the handle 102. In the preferred embodiment, the first and second handle openings 110, 112 have a height of 0.8 inches (2 cm), a width of 3.3 inches (8.5 cm) with the top of the first and second openings located 1.6 inches (4 cm) from the top edge margins 72, 24 of the closure and rear panels 70, 22 and the bottom of the first and second openings located 0.4 inches (1 cm) from the connection line 84. In one embodiment, a die or press (not shown) is used to cut the first and second openings 110, 112. The die or press may be used to cut the first and second openings 110, 112 together, after the closure panel 70 is formed.

Figure 9:
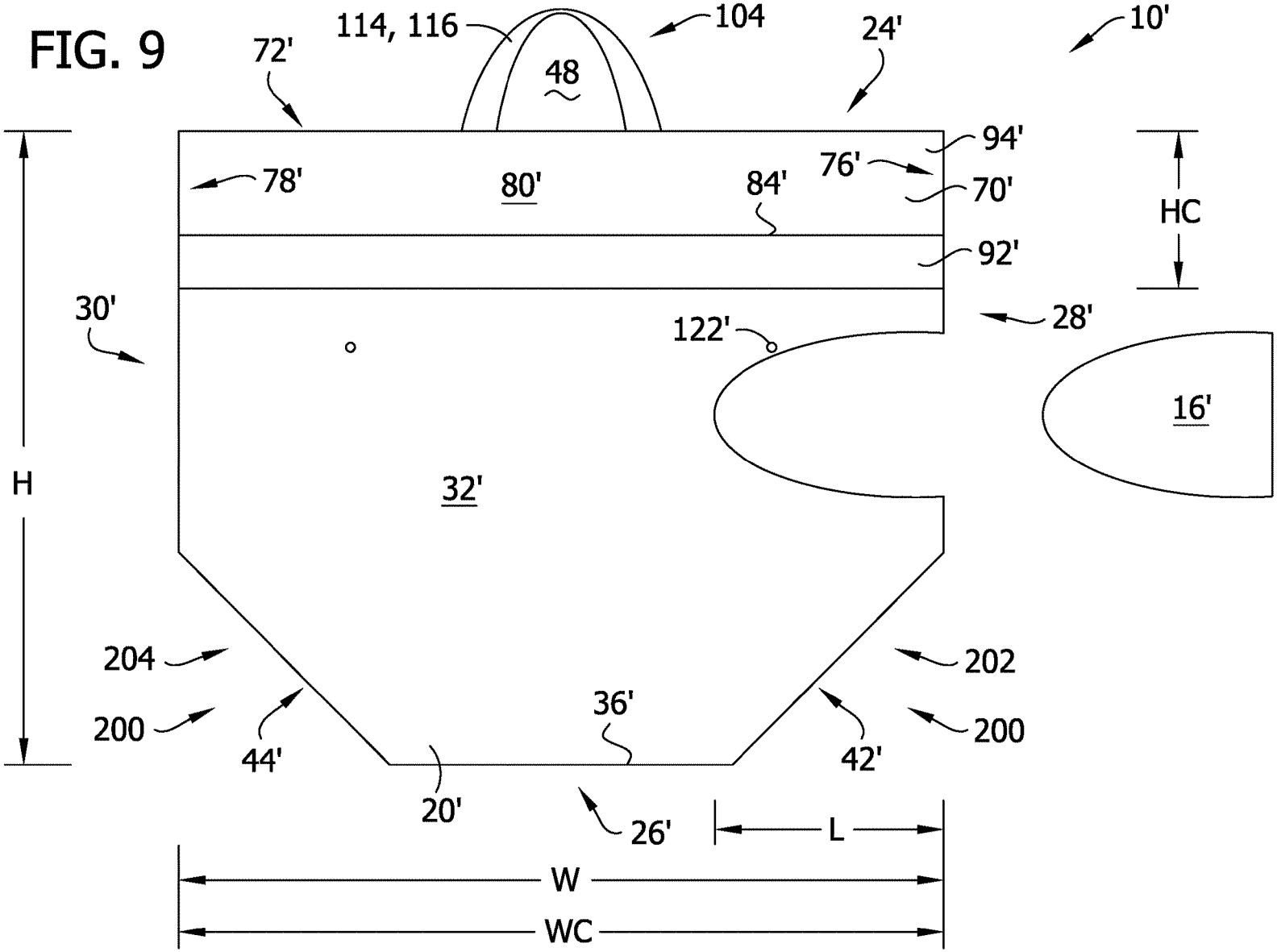
FIG. 9 is a front view of another embodiment of a tamper evident bag with tear out sections removed from the bag.

In the embodiment shown in FIG. 9, the bag 10' includes the soft-loop handle 104. The soft-loop handle is centrally located at the top of the bag 10'. The soft-loop handle 104 includes a first handle member 114 joined at opposite ends to the rear panel and a second handle member 116 joined at opposite ends to the handle portion 94' of the closure panel 70'. The first and second handle members 114, 116 can be made from the same material as the bag 10' or any other suitable material. In the illustrated embodiment, the first handle member 114 is joined at two locations to the front surface of the rear panel proximate the top edge margin 24' of the rear panel. The second handle member 116 is joined at two locations to the rear surface proximate the top edge margin 72' of the closure panel 70'. In this manner, the second handle member 116 is indirectly joined to the rear panel through the closure panel 70'. The second handle member 116 could optionally be directly joined to the rear panel. The handle members 114, 116 can be joined to the bag 10' with heat formed fusion lines, adhesive or any other suitable method. As shown in FIG. 9, the first and second handle members 114, 116 are aligned. The first and second handle members 114, 116 are configured to provide an opening 118 large enough to allow a user's hand to be inserted therethrough, permitting the user to grasp the bag 10'. In this embodiment, the top edge margins 72', 24' of the closure and rear panels 70' are not joined. Thus, the closure panel 70' is a separate piece of material from the rear panel, that is joined to the rear panel by fusion, adhesive or another suitable form of attachment. However, the portion of the first and second side edge margins 76', 78' in the handle portion 94' can be joined to the first and second side margins 28', 30' of the rear panel, as described above. In one embodiment, of the bag 10' has a height H that is different than bag 10. For example, the bag 10' with the soft-loop handle 104 configuration can be smaller than bag 10, with a height H of 16.5 inches (42 cm) while providing the same volume for receiving a container C or other items. In such an embodiment, the tear out sections 16' can be the same or different size as tear out sections 16.

In the embodiment shown in FIGS. 10 and 11, the bag 10" includes the wave-top handle 106. Bag 10" is similar to bags 10 and 10' except bag 10" does not have a closure panel that closes the first opening 12". Instead, the adhesive member 86" is located across either the rear surface 34" of the front panel 20" or, as shown, the front surface 32" of the rear panel 22" panel 22". The adhesive member 86 bonds to the opposite panel to permanently close the first opening 12". As shown in FIGS. 10 and 11, the wave-top handle 106 is centrally located at the top of the bag 10". The top edge margins 24" of the front and rear panels 20", 22" are curved in a wave-shape with an apex located at the midpoint of the width W of the bag 10". The wave-top handle 106 includes a first handle opening 110" on the front panel 20" and a second handle opening 112" on the rear panel 22". The first and second handle openings 110", 112" are aligned and located proximate the apex of the top edge margins 24" of the front and rear panels 20", 22". The first and second handle openings 110", 112" are generally circular and configured to allow a user's hand to be inserted therethrough, permitting the user to grasp the bag 10". In the preferred embodiment, the first and second handle openings 110", 112" have a diameter of 2.8 inches (7 cm) with the top of the first and second handle openings located 1.6 inches (4 cm) from the apex of the top edge margins 24". In one embodiment, bag 10" has a height H that is different than bags 10 and 10'. For example, the bag 10" with the wave-top handle 106 configuration can be larger than bags 10 and 10', with a height H of 19.5 inches (49.5 cm). In such an embodiment, the tear out sections 16" can be the same or different size as tear out sections 16 and 16". Even though bag 10" does not include a closure panel, the person of ordinary skill in the art understands that bag 10" operates in a similar manner as bags 10 and 10". Further, the person of ordinary skill in the art understands the wave-top handle may be incorporated into the handle portion 94 of the closure panel 70, thereby providing a bag with a wave-top handle and a closure panel to close the first opening.

The bags 10, 10', 10" can be formed from a unitary sheet of extruded polymeric film material. Such polymeric material can be polypropylene (PP), low-density polyethylene (LDPE), high density polyethylene (HDPE), linear low density polyethylene (LLDPE) or any other suitable material.

Figure 3:
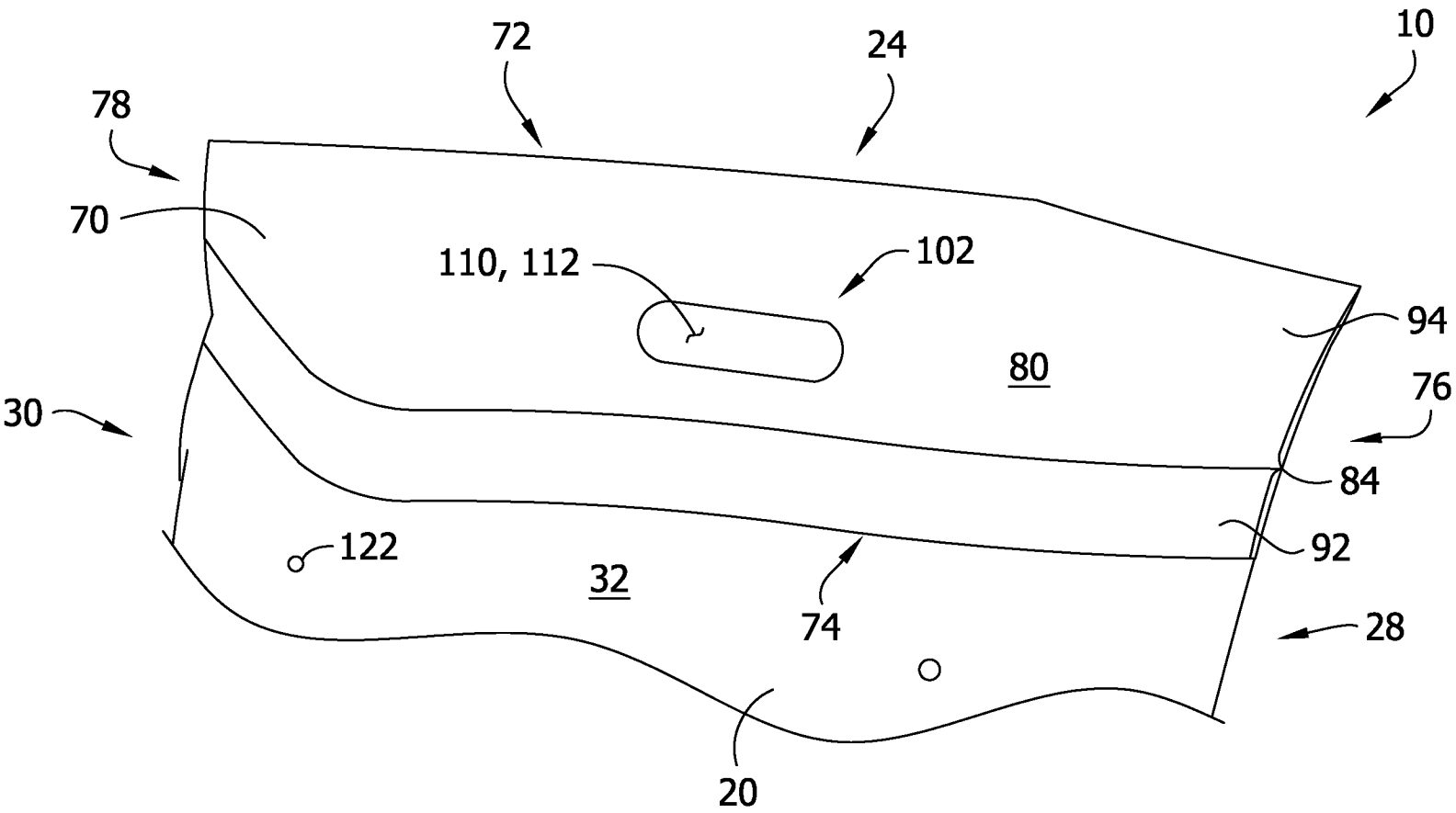
FIG. 3 is the perspective of FIG. 2 with a closed first opening.

The closure panel 70 is configured to be fixed to the front panel 20, by the user, to "permanently" close the bag 10 and restrict access to the bag interior 48. In operation, after items or containers C are placed in the bag interior 48 through the first opening 12 and the closure panel 70 closes the first opening. More specifically, the flap portion 92 of the closure panel 70 is positioned over the adhesive member 86, the release strip is removed and the flap portion is pressed against the adhesive 90 to permanently secure or fix the closure panel to the front panel 20 and close the opening 12. (FIG. 3). Once the adhesive 90 bonds to the closure panel 70, the seal between the closure and front panels cannot be broken without at least some damage to the bag 10. In this manner, the closure panel 70 permanently closes the first opening 12 of the bag 10 such that opening the bag to access the container C placed in the bag interior 48 requires damaging one of the front and rear panels 20, 22 and/or the closure panel such that the bag cannot be reclosed and/or such that the bag having been opened is apparent. In this way, a customer receiving the contents of the bag 10 can perform a quick visual inspection of the bag to check for any damage or signs that the bag interior 48 has been accessed. Due to the close proximity between the connection line 84, the top edge margin 24 of the front panel and the adhesive member 86, the flap portion 92 is held in place or located near the adhesive member—making the first opening 12 of the bag 10 easier to close. Because the flap portion 92 is held in place near the adhesive member 86, it is easier to get a smooth, flat seal when the two components are bonded, as opposed to bags whose closing components that are loose.

As shown in FIG. 7, the closure panel 70 enables the bag 10 to be permanently closed and subsequently opened in a controlled but destructive manner. To open the bag 10 after the first opening 12 is closed, the user or customer removes the tear out sections 16 to create the second opening 14. To remove the tear out sections 16 from the front and rear panel 20, 22, the user rips or tears the front and rear panels 20, 22 along the tear line 50 to separate the tear out sections 16 from the front and rear panels. If the tear out sections 16 contain finger slots 66, the user presses their finger against the finger slot 66 to separate the tear out section along the tear out line 50 and/or the finger slot line 68. The user then inserts their finger through the finger slot 66 to grip and remove the tear out section 16. The perforations 58 promote the tearing along the tear lines 50 in a controlled fashion. Once the tear out sections 16 are removed from the front and rear panels 20, 22, the second opening 14 is open and the user can access the bag interior 48 to remove the container C therein.

For ease of comprehension, where similar or analogous parts are used in the different embodiments, the same reference numbers with one or two primes are employed.

In view of the above, it will be seen that the several features of the invention are achieved and other advantageous results obtained.

Once closed, the tamper evident bag can only be opened though destructive means such as damaging the front, rear and/or closure panels or removing the tear out sections such that a visual inspection of the bag will reveal whether the contents placed inside the bag interior have been accessed.

Having described the invention in detail, it will be apparent that modifications and variations are possible without departing from the scope of the invention defined in the appended claims. For example, where specific dimensions are given, it will be understood that they are exemplary only and other dimensions are possible.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above products without departing from the scope of the invention, it is intended that all matter contained in the above description and shown in the accompanying drawings shall be interpreted as illustrative and not in a limiting sense.

What is claimed is:

1. A tamper evident bag comprising:

a front panel and a rear panel having front and rear surfaces and top, bottom, and opposite first and second side edge margins, the front and rear panels being connected together along the first and second side edge margins and the bottom edge margin to define a bag interior between the front surface of the rear panel and the back surface of the front panel, the front surface of the rear panel and the top edge margin of the front panel defining a first bag opening therebetween sized and shaped for inserting one or more items into the bag interior;

a closure panel configured to close the first bag opening, the closure panel mounted on the rear panel, closure panel including a flap portion and a handle mount portion; and a handle connected to the bag, the handle and first bag opening both disposed adjacent to the top edge margins of the front and rear panels, the handle including a first handle member joined to the rear panel and a second handle member joined to the handle mount portion of the closure panel;

the front and rear panels each having a tear line with a first end and a second end, the first and second ends being located at the first side edge margin, the first and second ends being spaced from the top and bottom edge margins and from each other, each tear line extending over the front and rear panels defining a respective tear out section therein, the tear lines being everywhere spaced from the second side edge margin, the tear out sections being joined along the first side edge margin and configured to be removed to create a second bag opening in the front and rear panels.

2. The tamper evident bag of claim 1 wherein the bag has a height and a midpoint along the height of the bag is located on the tear out sections.

3. The tamper evident bag of claim 1 wherein the tear lines on the front and rear panels are aligned with each other.

4. The tamper evident bag of claim 1 wherein the tear lines are formed of perforations.

5. The tamper evident bag of claim 1 further comprising an adhesive member on the front panel positioned to adhere the closure panel to the front panel so as to close the first bag opening.

6. The tamper evident bag of claim 1 wherein the closure panel is joined to a front surface of the rear panel between the top edge margin of the rear panel and the top edge margin of the front panel.

7. The tamper evident bag of claim 1 further including at least one vent hole.

8. The tamper evident bag of claim 1 wherein the tear lines have a first segment extending from the first side edge margin toward the second side edge margin, a second segment positioned between the first segment and the bottom edge margin and extending from the first side edge margin toward the second side edge margin, and a third segment interconnecting the first and second segments.

9. The tamper evident bag of claim 1 further comprising a bottom panel connecting the bottom edge margin of the front panel to the bottom edge margin of the rear panel, and configured to define a surface on which an item in the bag may rest when the bag is carried by the handle.

10. The tamper evident bag of claim 1 wherein at least one of the tear out sections includes a finger section defined at least in part by a finger tear line, the finger section sized and shaped to be engaged by a finger to facilitate removal of the tear out sections.

11. The tamper evident bag of claim 10 wherein said at least one tear out section has a height, the finger section having a height that is less than the height of the tear out section, and wherein the finger section is configured to be separated from the tear out section along at least a portion of the finger tear line when the finger section is engaged by the finger to create a finger opening sized and shaped to receive the finger.

12. A tamper evident bag comprising:

a front panel and a rear panel having front and rear surfaces and top, bottom, and opposite first and second side edge margins, the front and rear panels being connected together along the first and second side edge margins and the bottom margins to define a bag interior between the front surface of the rear panel and the back surface of the front panel, the top edge margin of the front panel extending across the front surface of the rear panel at a location spaced from the top edge margin of the rear panel toward the bottom edge margin of the rear panel, the front surface of the rear panel and the top edge margin of the front panel define a first bag opening therebetween; and a closure panel having top and bottom edge margins, the closure panel being secured to the rear panel and configured to close the first bag opening, the closure panel including a flap portion and a handle mount portion;

a first handle member joined to the rear; and a second handle member joined to the handle mount portion of the closure panel, wherein the front and rear panels further include tear out sections positioned along the first side edge margin and spaced from the top and bottom edge margins and second side edge margins of the front and rear panels, the tear out sections extending toward the second side edge margin along the front and rear panels, the tear out sections being configured to be removed to create a second bag opening.

13. The tamper evident bag of claim 12 wherein the top edge margins of the closure panel and the rear panel are co-extensive.

14. The tamper evident bag of claim 12 wherein the tear out sections are defined by perforations in the front and rear panels.

15. The tamper evident bag of claim 12 wherein at least one of the tear out sections includes a finger section defined at least in part by a finger tear line, the finger section sized and shaped to be engaged by a finger to facilitate removal of the tear out sections.

* * * * *